United States Patent [19]

Yoo

[11] Patent Number: 4,815,564

[45] Date of Patent: Mar. 28, 1989

[54] FOLDING LADDER

[76] Inventor: Hoe G. Yoo, 365-34 Deungchon-Dong, Kangseo-ku, Seoul, Rep. of Korea

[21] Appl. No.: 159,035

[22] Filed: Feb. 19, 1988

[30] Foreign Application Priority Data

Jun. 4, 1987 [KR] Rep. of Korea ..... 9016/1987

[51] Int. Cl.[4] ..... E06C 1/383

[52] U.S. Cl. ..... 182/160; 182/96; 182/163

[58] Field of Search ..... 182/156, 159, 160, 161, 182/162, 96, 95, 163

[56] References Cited

U.S. PATENT DOCUMENTS

| | | | |
|---|---|---|---|
| 1,783,686 | 12/1930 | Williams | 182/162 |
| 1,943,206 | 1/1934 | Corneloup | 182/162 |
| 2,981,364 | 4/1961 | Webber | 182/152 |
| 4,463,829 | 8/1984 | Grin | 182/96 |

FOREIGN PATENT DOCUMENTS

| | | | |
|---|---|---|---|
| 237767 | 1/1960 | Australia | 182/160 |
| 2649430 | 10/1976 | Fed. Rep. of Germany | 182/160 |
| 569962 | 11/1957 | Italy | 182/160 |

*Primary Examiner*—Reinaldo P. Machado

*Attorney, Agent, or Firm*—Birch, Stewart, Kolasch & Birch

[57] ABSTRACT

A folding ladder comprising a plurality of hingedly intermounted sections having channel-shaped side members, ladder rungs being shiftedly connected to a first of the side members and being pivotally connected to a second of the side members, such that the rungs slide upon collapse of the side members together after a folding of the sections into a compact unit for carriage and storage.

6 Claims, 7 Drawing Sheets

FOLDING LADDER

BACKGROUND OF THE INVENTION

The present invention relates to a folding ladder which provides improvements in folding and stability.

In a conventional folding ladder, there are provided a plurality of sections hingedly interconnected for folding, and having uniformly spaced-apart rungs pivotally attached to opposing side members of the sections to effect collapse of the opposite side members into contact with one another when the ladder is folded.

Thus, such ladders can be shortened in length when folded, but have drawbacks in that one of the side members protrudes beyond the other side member when folded such that the folded ladder remains bulky for carrying and storage.

Further, such ladders present a safety problem in that the ladder may collapse when fully erected.

SUMMARY OF THE INVENTION

It is therefore an object of the present invention to provide a folding ladder comprising a plurality of sections having channel-shaped side members along which the rungs may slide so as to both shorten and narrow the ladder in a most compact arrangement thereby providing a compact unit for carrying.

Another object of the present invention is to provide such a folding ladder as having feet to insure safety in use.

These objects and other features will become more apparent from the following detailed description.

DETAILED DESCRIPTION OF THE INVENTION

Figure 1:
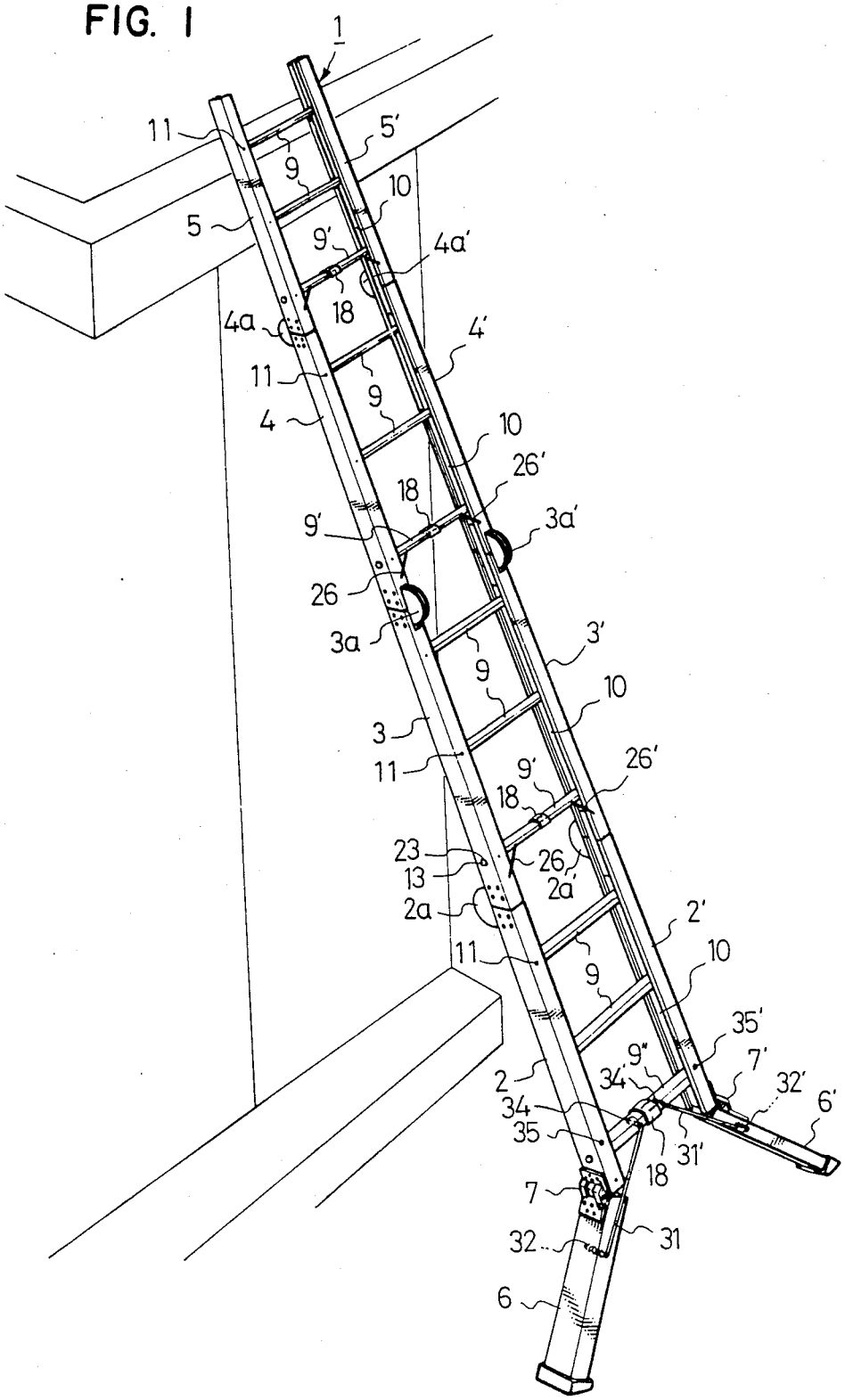
FIG. 1 is a perspective view of a folding ladder according to the invention, shown in its extended position in use.

Referring to FIG. 1, the folding ladder 1 according to the present invention comprises a plurality of sections (2, 2'; 3, 3'; 4, 4'; 5, 5') having opposing channel-shaped side members, the first side members 2', 3', 4', 5'having guide rails 22, 22' therein, the second side members 2, 3, 4, 5 having a plurality of holes formed therein for receiving pins 11, 11'. The sections are hingedly interconnected by hinges 2a, 3a, 4a and 2a', 3a', 4a' and have a plurality of rungs 9, 9', and 9'' pivotably attached between the first and second side members for retraction into the channels. Feet 6, 6' connected to the bottom of the lowest section by plane hinges 7, 7' and pins 8, 8' assure the stability of the ladder in an erected, operative position.

The lowermost rungs 9' of sections 3, 3'; 4, 4'; 5, 5'; and the lowermost rung 9'' of section 2, 2'; constitute critical constructive elements controlling the folding operation of the ladder according to the present invention and thus have different construction compared with the remaining rungs 9 of sections 2, 2'; 3, 3'; 4, 4'; 5, 5'.

Figures 3, 4, 5A, 5B:
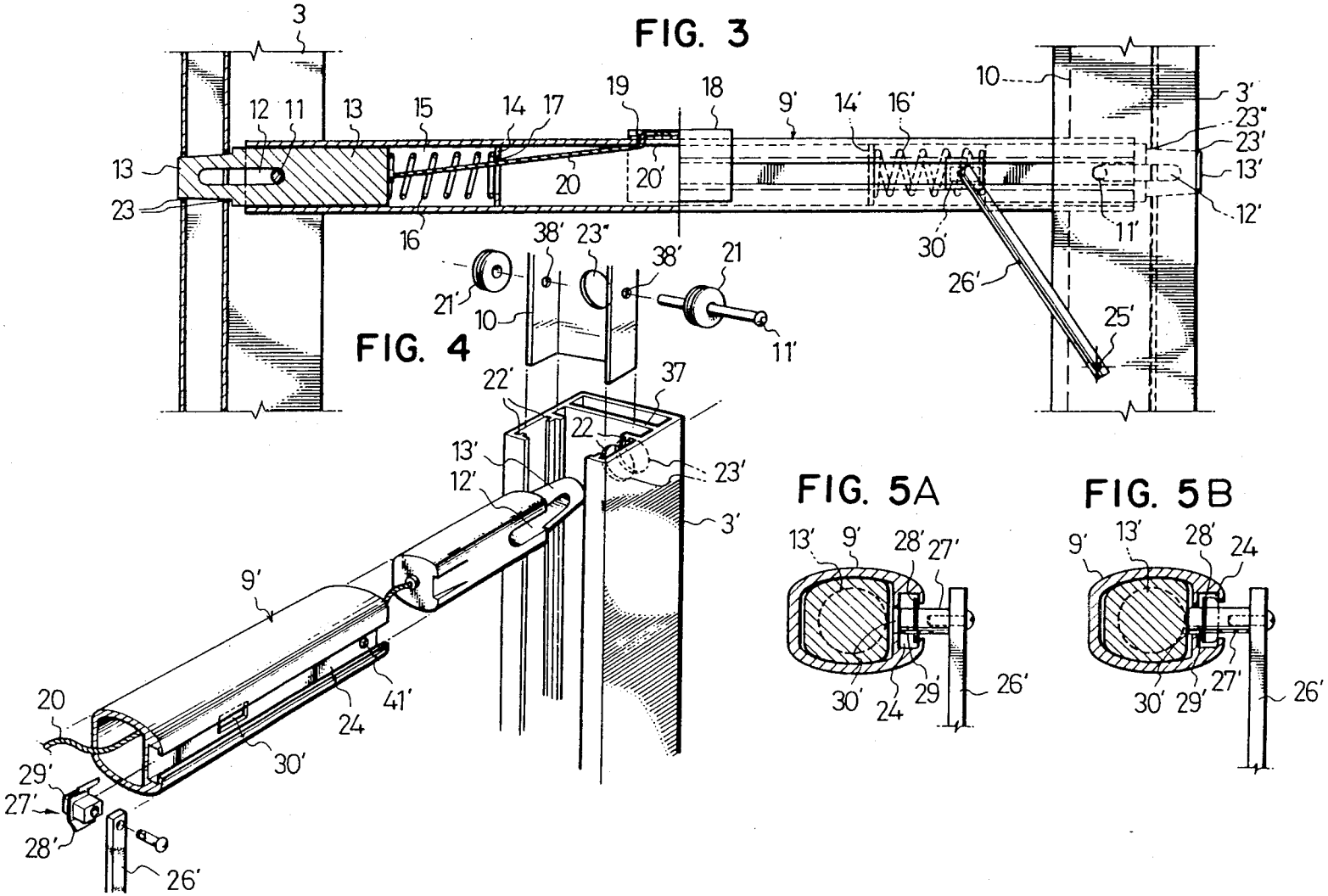
FIG. 3 is a partially broken and cross-sectional view, illustrating a rung attached to side members of the ladder.
FIG. 4 is a partial cutaway and exploded perspective view of the rung and the side member within which a sliding plate is to slide.
FIGS. 5A and 5B are sectional views of the rung, with a support rod shown released from a slot in the rung and shown locked into the slot, respectively.

Referring to FIGS. 3 and 4, the typical rung 9' is in the shape of a hollow rectangular bar having a saddle 18 at the intermediate portion thereof. The inside rung 9', partitions 14, 14' are equidistant from the saddle 18, having apertures 17, 17' (see FIGS. 6A to 6D) through which a flexible cord 20 passes. Springs 16, 16' are located within the rung 9' and respectively abut partitions 14, 14' at one end thereof and at the other end abut against locking protrusions 13, 13', also located within the rung 9' and containing elongated through elongated openings 12, 12', respectively. The cord 20, attached to the center portion of the inner surface of one locking protrusion 13, passes through the aperture 17 in the partition 14, apertures 19, 19' in the saddle 18 and the aperture 17' in the partition 14', and is attached to the center portion of the inner surface of the other locking protrusion 13', as shown in FIG. 6D. On the side wall of the rung 9' is a C-shaped guid groove 24 for guiding a pair of supports 27 (not shown), 27' attached to one end of support rods 26, 26', as shown in FIGS. 4 and 8B, and is formed with a pair of slots 30, 30' for locking the supports 27, 27', respectively.

Figure 7:
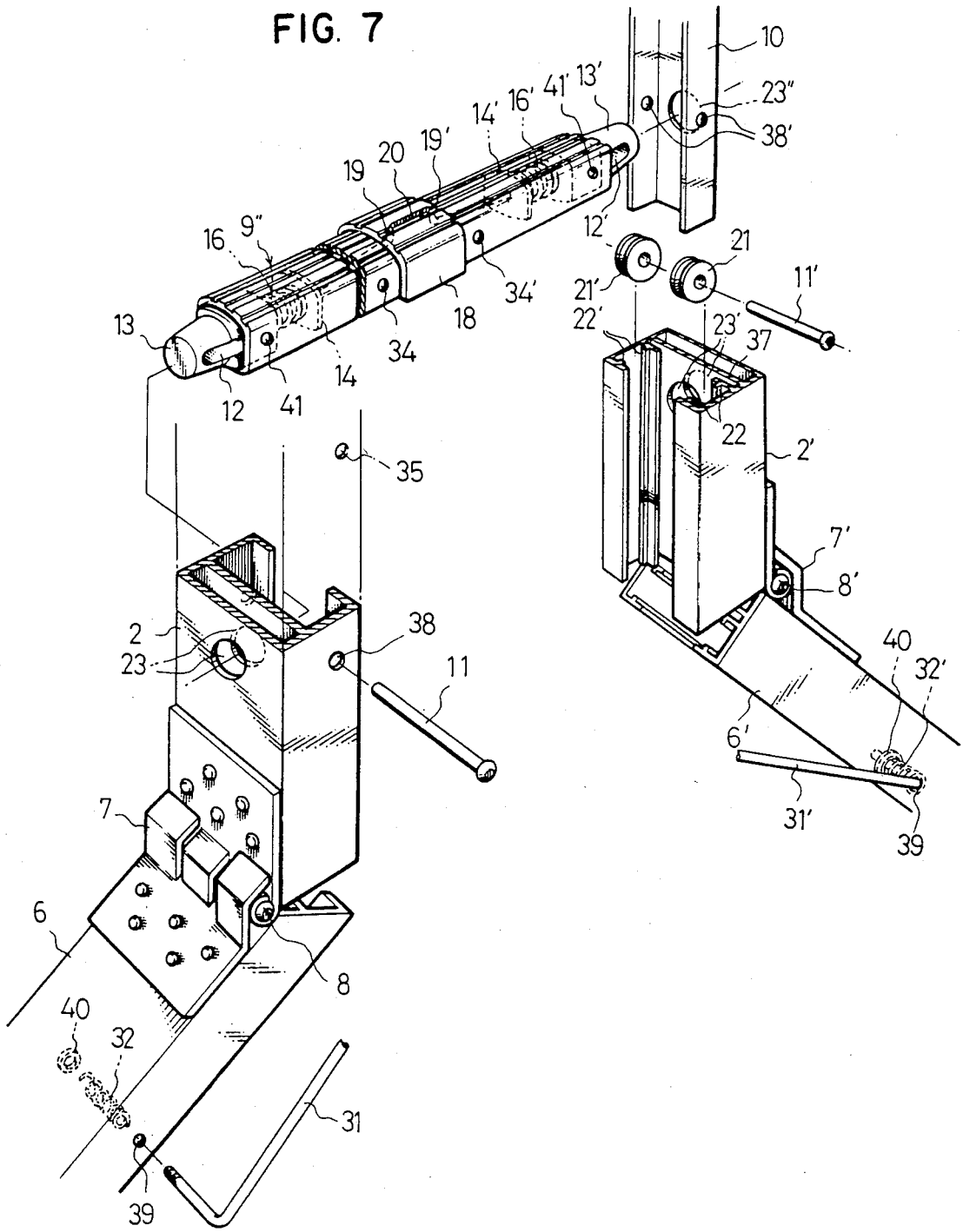
FIG. 7 is an exploded perspective view illustrating another rung according to the present invention and feet hingedly connected to the side members.

As shown in FIG. 7, rung 9'' is substantially the same as rung 9' except that the former has support holes 34, 34' in its side wall for the reception of support rods 31, 31', while the latter rung 9' has guide grooves 24 and slots 30, 30'. The remaining rung 9 is not limited in configuration.

In each of the first side members 2', 3', 4', 5', as shown by way of example in FIGS. 4 and 7, there is provided a reinforcing plate 37 and two pairs of guide rails 22, 22' for the sliding reception of a slide plate 10. The slide plate 10 has a U-shaped cross section and is sufficiently shorter than the corresponding side member in the movement direction of the slide plate 10 so that it does not protrude beyond the end of the side member when the ladder is folded. At its lower portion, the slide plate 10 has an opening 23'' through which the outer end of the locking protrusion 13' may extend, and further has opposed holes 38' in the side wall thereof. Thus, the pin 11' may be gradually inserted through a roller 21, one hole 38', a hole 41' transversely penetrating the hollow rung 9', the elongated opening 12', the other hole 38', and a roller 21' so as to combine the rollers 21, 21', the slide plate 10 and the protrusion 13' together. The rollers 21, 21' are in rolling engagement with the guide rails 22, 22' thereby allowing the slide plate 10 to slide in the channel. Openings 23' for locking protrusion 13' are located in the reinforcing plate and in the outer wall of the first side members 2', 3', 4', 5' so as to permit the protrusions 13' to extend beyond the openings 23' thereby locking when the ladder is extended.

Each of the second side members 2, 3, 4, 5, as shown in FIG. 7, is substantially the same as each of the first side members 2', 3', 4', 5' except that the former has a plurality of holes 38 located therein for the attachment of one end of the rungs 9, 9', 9'' thereto by the pins 11, while each of the latter member has the slide plate 10 and the guide rails 22, 22'.

Each rung is attached to the second side members 2, 3, 4, 5 at the one end thereof by means of the pin 11, and at the other end to the slide plate 10 by means of the pin 11'. The slide plate 10 is mounted for sliding movement within each of the first side members 2', 3', 4', 5'. Particularly, the rollers 21, 21', attached to the side wall of the slide plate 10 by the pin 11', are arranged to be engaged with the guide rails 22, 22' for insuring the sliding movement of the slide plate 10.

In order to insure the locking of the rungs 9' to the side members 3,4,5 and 3', 4', 5' when the ladder 1 is extended, the support rods 26, 26' are secured between the members and each rung 9', as shown in FIG. 1. One support rod 26' is shown by way of example in FIGS. 3 to 5. That is, the support rod 26' is pivotally attached to the side member 3' by means of a pivot pin 25' at one end thereof and at the other end is provided with the support 27' including a resilient piece 28' and a support protrusion 29' thereby having the ability to slide in a guide groove 24.

Thus, while the ladder 1 is extended, the supporting protrusion 29' of the support 27' slides in the guide groove 24 and is locked into the slot 30' (as shown in FIG. 5B) as the ladder is completely extended. Conversely, upon the manually pulling rod 26' and the attached support 27' during a folding of the ladder 1, the protrusion 29' disengages from the slot 30' and is free to slide along the groove 24 in a released position, as shown in FIG. 5A.

Referring again to FIG. 7, the folding ladder according to the present invention is provided with the feet 6, 6' hingedly connected to the lower ends of the side members 2, 2' by the plane hinges 7,7' and pins 8,8' in such a manner that the feet 6,6' are suitably spaced apart relative to one another so as to insure stability in use. Each of the feet 6, 6' is similar in construction to its corresponding side member. Holes 39, 39' are located in the front side wall of the feet 6,6' through which ends of the support rods 31, 31' are attached with nuts 40, 40' via embedded springs 32, 32' which resiliently urge the support rods in place. When the ladder 1 is extended the other ends of the support rods 31, 31' are manually inserted into the support holes 34, 34' respectively to support the rung 9'', and when the ladder is folded the support rods 31, 31' are fastened into the respective holes 35, 35' located in the side members 2, 2' so that the feet 6, 6' are secured.

Now, the folding and extending operations of the foregoing construction of the ladder 1 according to the present invention will be described in detail with reference to FIGS. 2A to 2C, 6A to 6D and 8A, 8B.

Figure 6A:
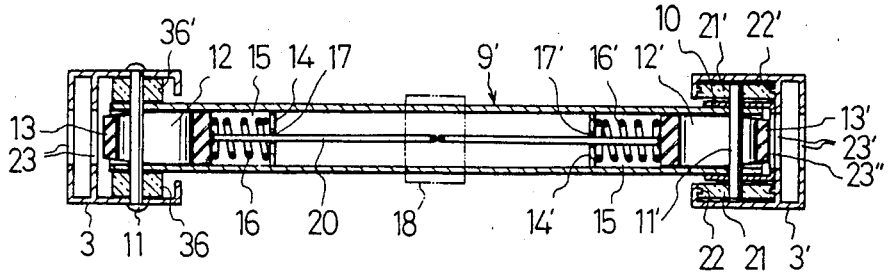
FIG. 6A is a transverse cross-sectional view of the ladder, with locking protrusions of the rung shown out of engagement with openings in the opposing side members.
Figure 6C:
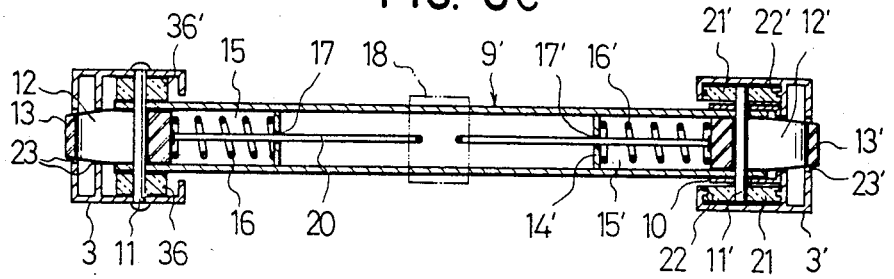
FIG. 6C is a transverse cross-sectional view of the ladder, showing the locking protrusions of the rung locked into the openings in the opposing side members.
Figure 6B:
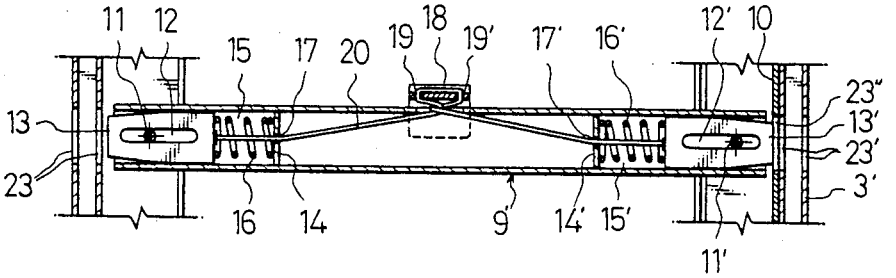
FIG. 6B is a vertical cross-sectional view of FIG. 6A.
Figure 6D:
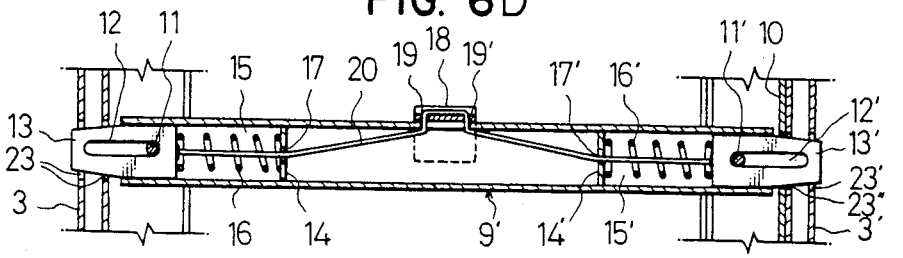
FIG. 6D is a vertical cross-sectional view of FIG. 6C.

To fold the ladder 1 from its extended position of FIG. 1, each saddle 18 of the rungs 9', 9'' is pulled up and rotated through 180 degrees about its vertical axis from its original position illustrated in FIGS. 6C and 6D to the position illustrated in FIGS. 6A and B. In the process of rotation, the cord 20 passing through the apertures 19, 19' of the saddle 18 is wound to a length equal to the distance between the holes 19 and 19', thereby shortening the distance between opposite ends of the cord 20 and accordingly releasing the locking protrusions 13, 13'of the rungs 9' and 9'' from the openings 23, 23', 23'' and thus compressing the springs 16, 16'. As described hereinabove, each of the slide plates 10 is slidably mounted within each of the first side members 2', 3', 4', 5'. The rungs 9', 9'' are pivotally attached to the second side members 2, 3, 4, 5 at the one end thereof by the pins 11 respectively, and at the other end pivotally attached to the sliding plates 10 by the pins 11' respectively in such a manner that the rungs 9', 9'' may slide in the first side members 2', 3', 4', 5'. However, the rungs 9 are pivotally attached at both ends to the second side members and to slide plates 10 by the pins 11, 11', respectively.

Subsequently, the support protrusions 29, 29' locked into the respective slots 30, 30' are disengaged from the slots 30, 30' by hand to slide in the guide groove 24, as shown in FIG. 5A, and similarly the ends of the support rods 31, 31' locked to the support holes 34, 34' respectively are manually removed from such holes and are inserted into the holes 35, 35' respectively. In accordance with these procedures the ladder according to the invention can be easily folded without any interference.

Figure 2A:
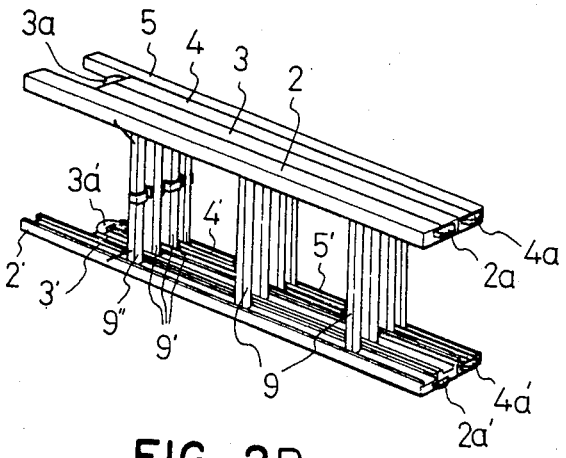
FIGS. 2A, 2B and 2C illustrate the folding procedure of the ladder of FIG. 1.

Continued folding procedures are described by way of example with reference to FIGS. 2A to 2C and 8A, 8B as follows:

The ladder 1 is manually folded, as in FIG. 2A, in sections at hinges 2a, 2a', 3a, 3a', 4a, 4a'. The feet 6, 6' are omitted in FIG. 2A for the sake of clarity.

Figure 2B:
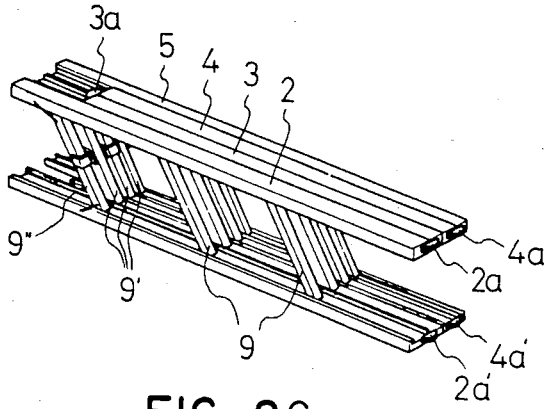
Figure 8A:
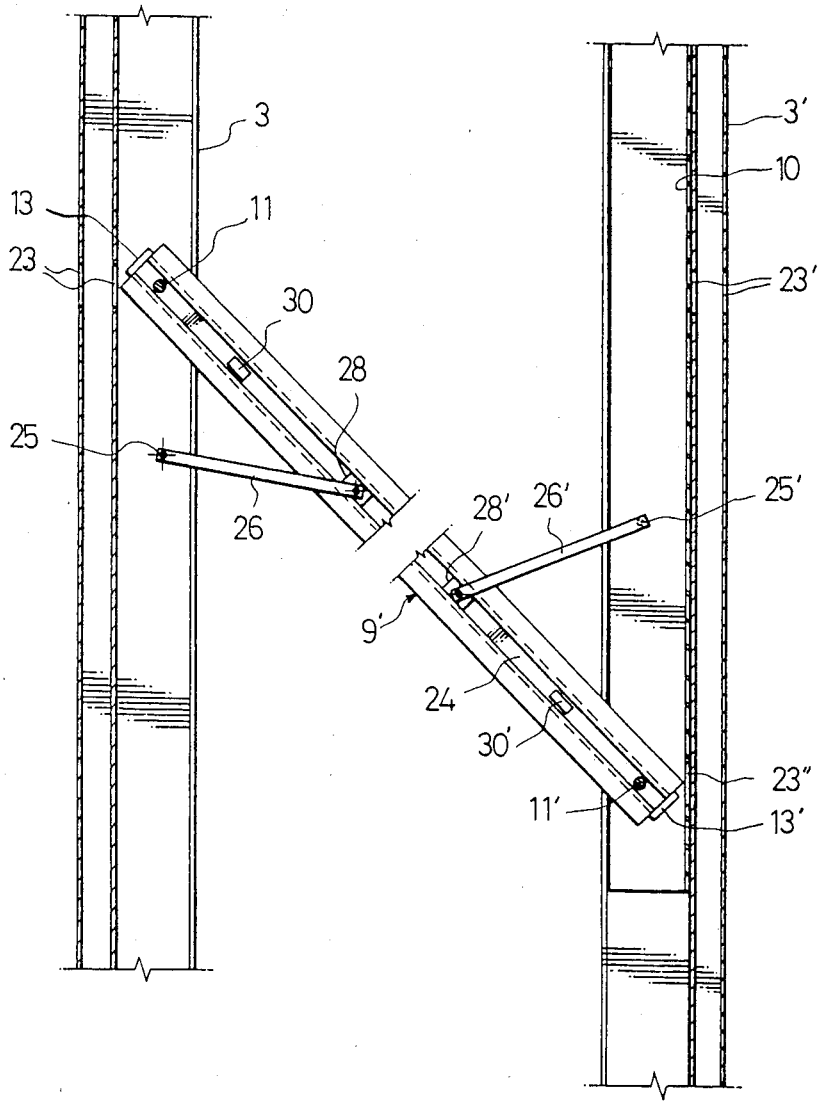
FIGS. 8A and 8B illustrate the sliding movement of the rung into the side members, according to the present invention.
Figure 8B:
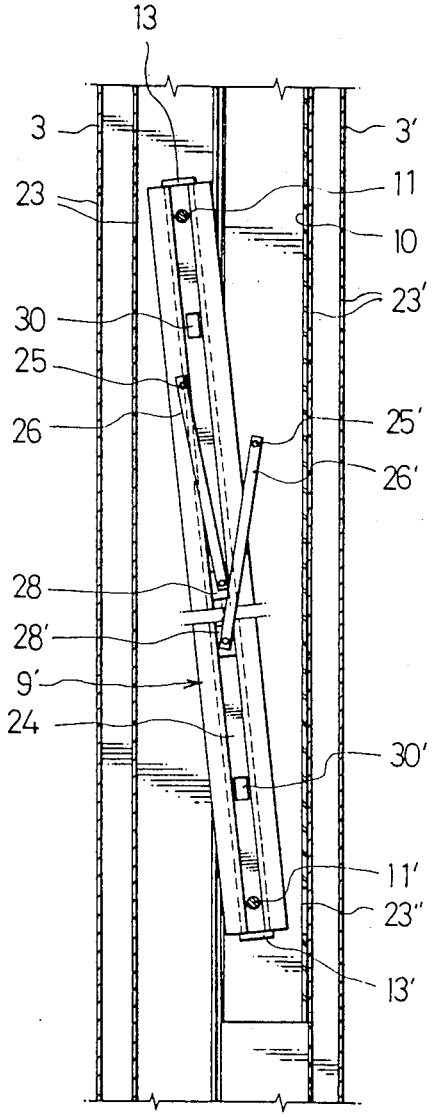

Upon compressing the opposing side members toward each other, as shown in FIG. 2B, one end of the respective rungs 9, 9', 9'' attached to the second side members 2, 3, 4, 5 pivots and the other end, attached to the slide plate 10, is moved downward as viewed in FIG. 8A, together with the slide plate 10, and accordingly the distance between the opposite side members narrows. Meanwhile, the ends of the support rods 26, 26' are moved along the guide groove 24 of the rung 9'. Upon further compressing the opposite side members, the rungs 9, 9', 9'' are received within the respective channel-shaped side members, as shown in FIG. 8B.

Figure 2C:
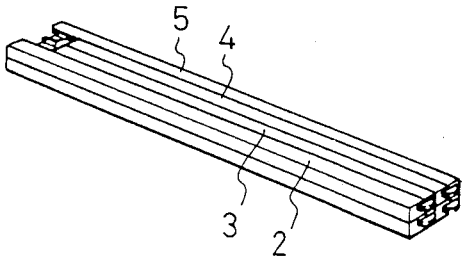

Therefore, the folding ladder 1 according to the present invention can be folded completely into a compact unit shown in FIG. 2C.

To extend the folded ladder, the foregoing procedures are reversed. That is, while opposing side members are pulled apart by hand, the protrusions 29, 29' of the supports 27, 27' attached respectively to the ends of the support rods 26, 26' slide along the guide groove 24 until they snap into the respective slots 30, 30'. Then, upon pulling upward and rotating the saddle 18 through 180 degrees to its original position, the stored forces of compressed the springs 16, 16' are released and accordingly the locking protrusions 13, 13' are urged outwardly and are locked into the respective openings 23, 23', 23''.

In addition, the ends of the support rods 31, 31' are removed from the respective holes 35, 35' and are inserted into the support holes 34, 34' in the rung 9'' while maintaining the feet 6, 6' separated so as to assure stability of the ladder 1.

According to another embodiment (not shown), the slide plates 10 are capable of movement upwardly instead of downwardly, and the overall length of the lowest section with the feet aligned therewith for carrying is equal to that of the other sections so as to prevent the feet from protruding.

It is understood from the heretofore description that since the ladder according to the present invention is easily folded and extended and thus is compact, it is not only convenient to carry and store but safe in use.

While the invention has been illustrated and described with reference to simple embodiment, it is recognized that variations and changes may be made therein without departing from the scope and spirit of the invention as set forth in the appended claims.

What is claimed is:

1. A folding ladder comprising, at least two ladder sections hingedly interconnected to permit folding said sections from an aligned unfolded position to an overlying folded position, each of said sections comprising opposed first and second channel-shaped, elongated side members and ladder rungs extending therebetween, said first side members each having a pair of opposed, longitudinal, internal guide rails for guiding slideable plates located in each of said first members, each of said rungs being pivotally connected at one end thereof to said second members and being pivotally connected at the opposite end thereof to said slideable plates, one of said rungs of each said section comprising a hollow bar containing a pair of axially movable locking protrusions respectively located at said ends of said bar, said first and second members and said plates having openings aligned with each of said rungs, means biasing said protrusions outwardly of said ends of said hollow bar into engagement with said openings in a locked position of said members, a manually liftable saddle element on said bar between said ends thereof, said saddle element having a pair of spaced apertures, a cord extending through said apertures and being connected at opposite ends thereof to said locking protrusions, said cord extending untwisted through said apertures when said protrusions engage said openings, and said cord being twisted on itself upon manually lifting and rotating said saddle element for shifting said locking protrusions inwardly of said bar out of engagement with said openings to facilitate movement of said side members toward one another in complete overlying relationship as said plates slide along said rails.

2. The ladder according to claim 1, wherein each of said side members has a reinforcing plate with openings aligned with the aforementioned openings, said protrusions extending through said openings of each said reinforcing plate in said locked position.

3. The ladder according to claim 1, further comprising rollers on said plates in rolling engagement with said rails.

4. The ladder according to claim 1, wherein one of said sections is adapted to be supported on the ground, said hollow bar of only the other of said sections having an open, longitudinal guide groove, support rods each pivotally connected at one end thereof respectively to said members, and said rods each being connected at an opposite end thereof to said hollow bar for sliding movement along said groove upon the movement of said members toward one another.

5. The ladder according to claim 1, further comprising foot members hingedly connected to said side members of one of said sections.

6. The ladder according to claim 5, further comprising support rods extending between a lowermost one of said rungs and said foot members.

* * * * *